US005433178A

United States Patent [19]

Urmaza

[11] Patent Number: 5,433,178

[45] Date of Patent: Jul. 18, 1995

[54] ROCKER ARM ASSEMBLY AND METHOD OF ASSEMBLY

[75] Inventor: Matthew G. Urmaza, Torrington, Conn.

[73] Assignee: The Torrington Company, Torrington, Conn.

[21] Appl. No.: 279,582

[22] Filed: Jul. 25, 1994

[51] Int. Cl.[6] ..... F01L 1/18

[52] U.S. Cl. ..... 123/90.41; 74/519; 74/559

[58] Field of Search ..... 123/90.39, 90.41, 90.42, 123/90.44, 90.47; 74/519, 559

[56] References Cited

U.S. PATENT DOCUMENTS

| | | | |
|---|---|---|---|
| Re. 33,870 | 4/1992 | Fittro et al. | 123/90.410 |
| 3,251,350 | 5/1966 | Thompson | 123/90.41 |
| 3,466,073 | 9/1969 | Pohle | 123/90.39 |
| 3,621,823 | 11/1971 | Lombardi | 123/90.42 |
| 4,314,732 | 2/1982 | Murphy | 123/90.41 |
| 4,577,911 | 3/1986 | Fredericksen et al. | 308/2 R |
| 4,674,453 | 6/1987 | Dove, Jr. | 123/90.39 |
| 4,697,473 | 10/1987 | Patel | 123/90.39 |
| 4,718,379 | 1/1988 | Clark | 123/90.39 |
| 4,724,802 | 2/1988 | Ishii | 123/90.39 |
| 4,727,832 | 3/1988 | Miyamura et al. | 123/90.39 |
| 4,858,575 | 8/1989 | Fittro et al. | 123/90.41 |
| 4,878,463 | 11/1989 | Fredericksen et al. | 123/90.41 |
| 4,896,635 | 1/1990 | Willermet et al. | 123/90.41 |
| 4,944,257 | 7/1990 | Mills | 123/90.34 |
| 4,967,705 | 11/1990 | Maciag et al. | 123/90.48 |
| 5,063,889 | 11/1991 | Pryba et al. | 123/90.41 |
| 5,074,261 | 12/1991 | Hamburg et al. | 123/90.39 |
| 5,123,384 | 6/1992 | Abbas | 123/90.41 |
| 5,195,475 | 3/1993 | Murphy et al. | 123/90.39 |
| 5,297,509 | 3/1994 | Murphy | 123/90.39 |
| 5,313,916 | 5/1994 | Murphy | 123/90.39 |
| 5,329,891 | 7/1994 | Murphy et al. | 123/90.39 |

*Primary Examiner*—Henry C. Yuen
*Assistant Examiner*—Weilun Lo
*Attorney, Agent, or Firm*—John C. Bigler

[57] ABSTRACT

A bearing support member has two support arms extending in opposite directions along an axis. A bearing cup extends over each support arm and into a bore of the rocker arm and has a radially outwardly extending protrusion engageable with the rocker arm to limit axially outward movement of the bearing cups. A radially inwardly extending protrusion of the bearing cups abuts rolling members between the bearing support member and the bearing cups to limit axially outward movement of the rolling members. A stepped bearing sleeve and pedestal may be provided to limit axially inward movement of the rolling members. During assembly, components are inserted through an opening in the rocker arm intersecting the bore.

16 Claims, 3 Drawing Sheets

ROCKER ARM ASSEMBLY AND METHOD OF ASSEMBLY

BACKGROUND OF THE INVENTION

This invention relates generally to valve operating mechanisms for use in internal combustion engines and, more particularly, to an oscillating rocker arm assembly with rolling members and to a method of assembly therefor.

Typically, a rocker arm assembly with rolling members is supported on a support shaft mounted perpendicularly on a support stud extending from the head of the engine. The rocker arm is pivoted on the support shaft, which serves as an inner raceway, by means of drawn cup needle roller bearings mounted on the rocker arm. If desired, a bearing sleeve may be mounted on the support shaft to provide the inner raceway, permitting use of a non-cylindrical support arm and facilitating the use of powder metal forming.

Axial retention of needle roller bearings of rocker arm assemblies is of critical importance. Inadequate axial retention of the needle roller bearings could result in the bearing cup "walking" out of the bore of the rocker arm, possibly causing catastrophic failure of the engine.

To provide axial retention of needle roller bearings on the rocker arm, two approaches have been used. In some rocker arm assemblies, a split ring engages a groove in each end of the support shaft to prevent axial movement of the needle roller bearings, i.e., movement axially outward with respect to the support shaft. Such retention requires the step of machining a groove in each end of the support shaft and the step of applying the split rings over the support shaft, both adding to the cost of the rocker arm assembly.

Alternatively, or in combination with the use of split rings over the ends of the support shaft, the needle roller bearings may be axially retained by a press fit within a bore of the rocker arm. In order to provide the required dimensional interference between the cup of the needle roller bearings and the rocker arm, the bore of the rocker arm must be accurately machined to tight tolerances with respect to the cups of the needle roller bearings, adding considerable cost to the rocker arm assembly.

The foregoing illustrates limitations known to exist in present rocker arm assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a rocker arm assembly comprising a rocker arm, having a bore extending along an axis, and a bearing support member, having two support arms extending in opposite directions along the axis of the bore. A bearing cup extends over at least a portion of each support arm and into the bore of the rocker arm, each bearing cup having a radially outwardly extending abutment means, engageable with the rocker arm such that axially outward movement of the bearing cup is limited, and a radially inwardly extending abutment means. Rolling members are provided within an annulus between the bearing support member and the bearing cups such that the rocker arm is rotatable with respect to the bearing support member and such that axially outward movement of the rolling members is limited by engagement with the radially inwardly extending abutment means of the bearing cups.

In another aspect of the present invention, this is accomplished by providing a method of assembling a rocker arm assembly.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
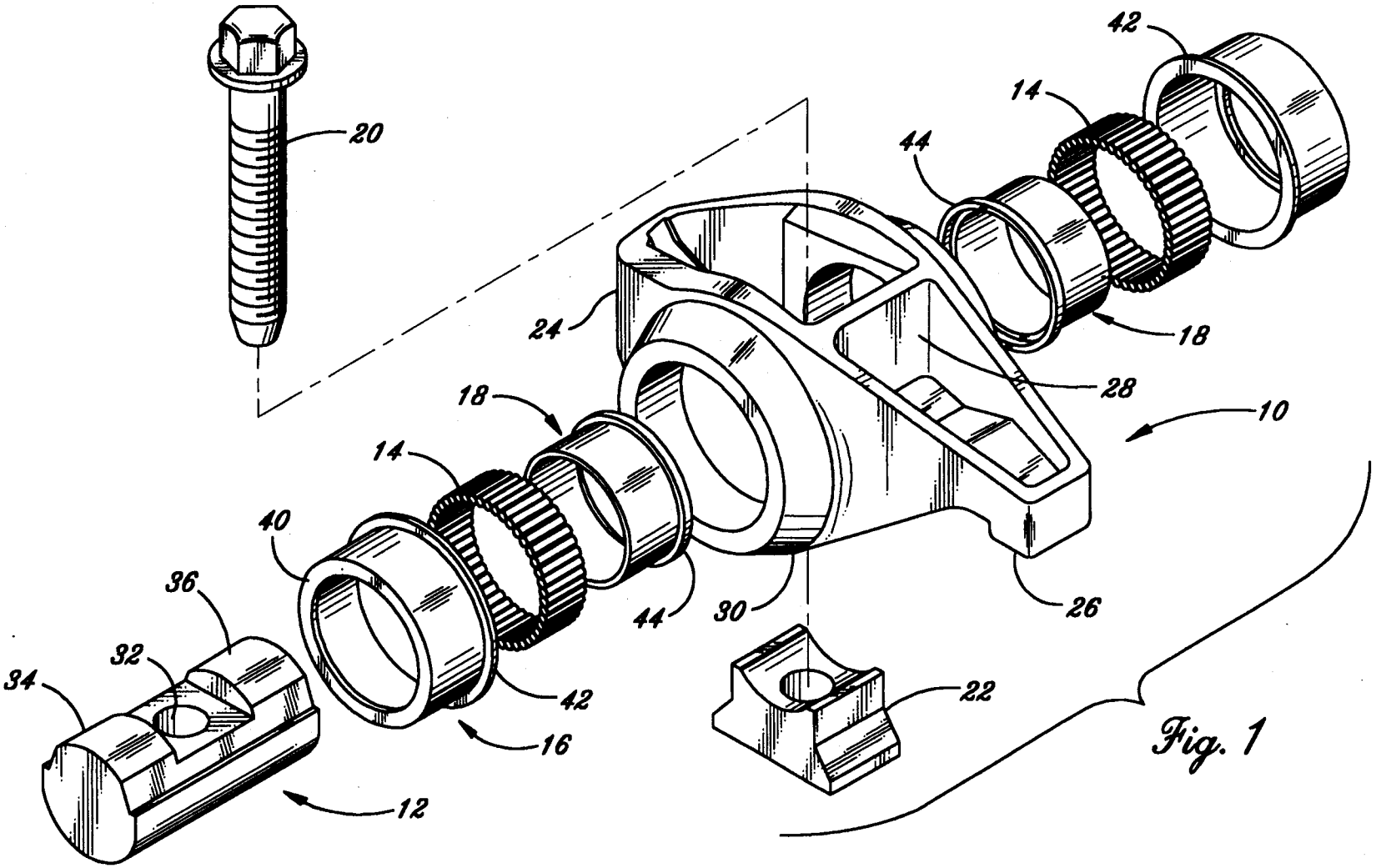
FIG. 1 is an exploded pictorial view illustrating an embodiment of the rocker arm assembly of the present invention.

Referring now to the drawings, FIG. 1 illustrates an embodiment of the present invention having rocker arm 10 supported on bearing support member 12 by rolling elements 14 within an annulus between bearing cups 16 and bearing sleeves 18. Support member 12 can be mounted on pedestal 22, by a cap screw, bolt or other stud means 20, for example, on a cylinder head of an internal combustion engine.

Rocker arm 10 has first end 24 for engagement with a push rod, not shown, and second end 26 for engagement with a valve stem of a poppet valve, not shown. In the embodiment shown, rocker arm 10 is of a cast configuration including reinforcing web 28 and flanges 30, providing added strength and rigidity. However, the rocker arm assembly of the present invention may be employed with stamped or cast rocker arms of various configurations.

Figure 2:
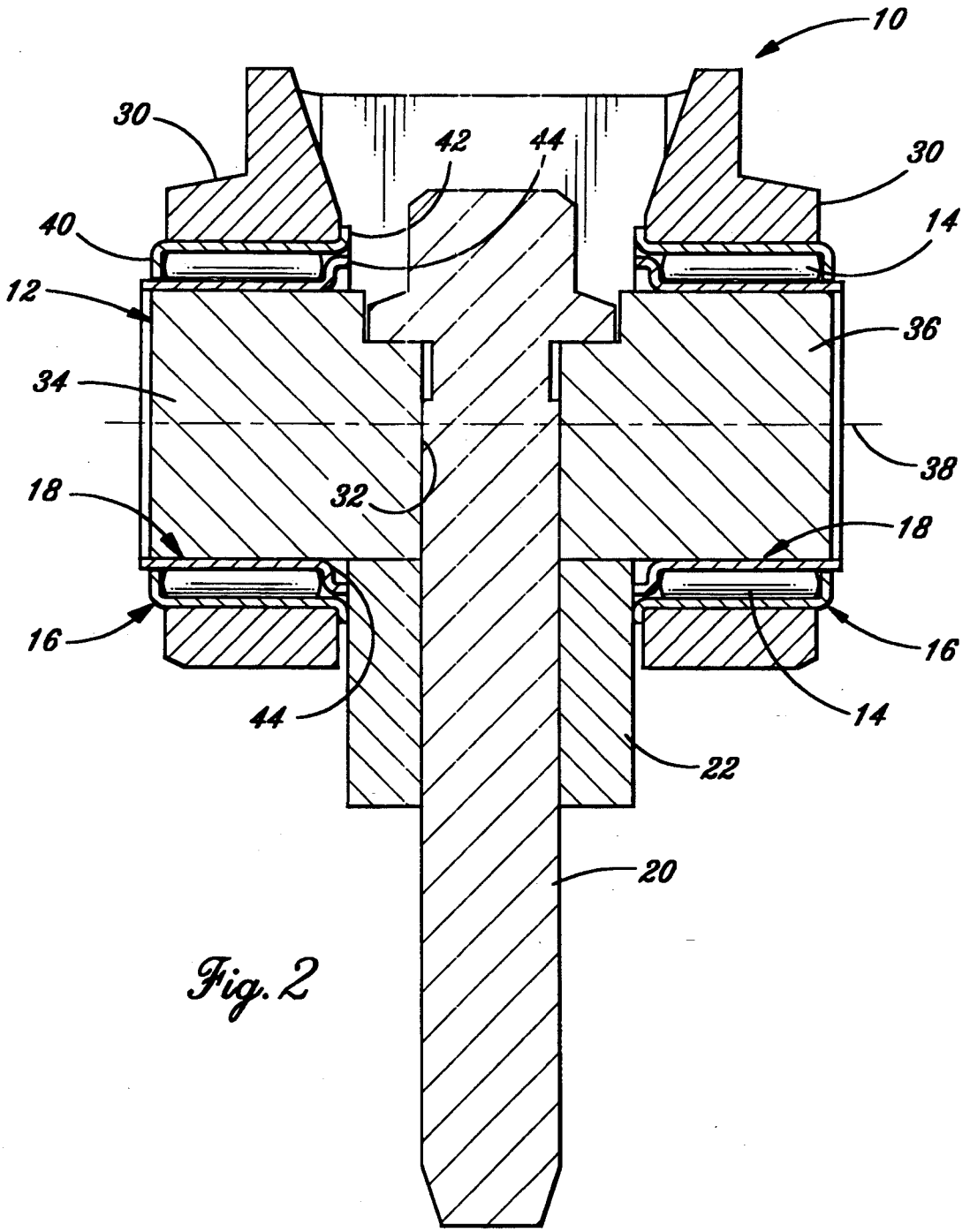
FIG. 2 is an enlarged cross-sectional view of the rocker arm assembly of FIG. 1.

As illustrated in FIG. 2, bearing support member 12 has a substantially vertical bore 32 for receiving stud means 20 to mount the rocker arm assembly. Bearing support member 12 has support arms 34 and 36 which extend in opposite directions along a common axis 38 perpendicular to stud means 20. Rolling elements 14 may be a full complement of needle rollers, as illustrated, or may employ other types of rolling members 14, with or without cages or retainers.

Bearing cups 16 are positioned within two spaced apart side portions of rocker arm 10, along axis 38 of bearing support member 12. In the embodiment shown, for example, two spaced apart apertures in the side portions of rocker arm 10 receive bearing cups 16. Bearing cups 16 have cylindrical side walls providing outer raceways for rolling members 14.

Bearing cups 16 have radially inwardly extending flanges 40, extending circumferentially, or other radially inwardly extending abutment means, that are engageable with ends of rolling members 14 such that axially outward movement of rolling members 14 is limited. Radially outwardly extending flanges 42, extending circumferentially, or other radially outwardly extending abutment means of bearing cups 16, are engageable with rocker arm 10 such that axial movement of bearing cups 16 and rolling members 14 away from stud means 20 is limited.

Bearing sleeves 18 are formed with an open bottom and cylindrical side walls. The cylindrical side walls provide inner raceways for rolling members 14 and facilitate use of powder metal forming of bearing support member 12 by allowing support arms 34 and 36 to have a noncylindrical configuration, as shown. Bearing sleeves 18 have radially outwardly extending flanges 44, extending circumferentially, or other radially outwardly extending abutment means, that are engageable with rolling members 14 and pedestal 22 such that axial movement of rolling members 14 toward stud means 20 is limited.

Thus, pedestal 22 prevents bearing cups 16 and bearing sleeves 18 from moving axially inward. Flanges 42 of bearing cups 16 prevent bearing cups 16 from moving axially outward and, acting through rolling elements 14, prevent bearing sleeves 18 from moving axially outward. Preferably, flanges 44 of bearing sleeves 18 include a step, spacing the inner raceway portion axially from pedestal 22 as shown, such that the effective length of rolling elements 14 does not overlie the radiused portion forming flanges 42 of bearing cups 16.

Due to the presence of radially outwardly extending flanges 42 of bearing cups 16, the needle roller bearing components of the rocker arm assembly of the present invention cannot be installed inwardly, as is the normal practice when assembling rocker arm assemblies. Instead, those components are installed outwardly, through either a top or bottom "window" of rocker arm 10 that is large enough to accommodate bearing cup 16 and bearing sleeve 18.

Figure 3:
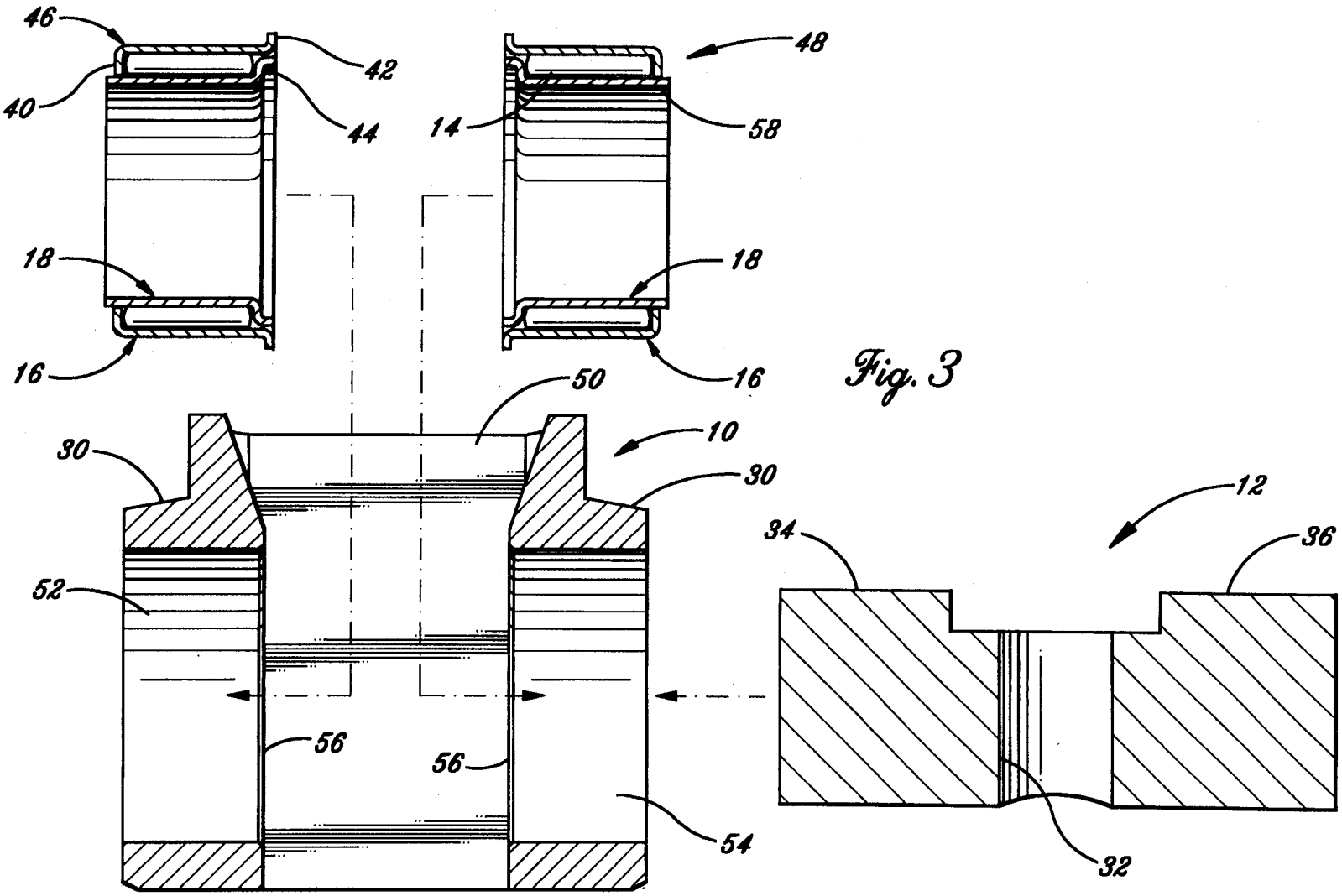
FIG. 3 is a diagram of portions of the rocker arm assembly of FIG. 1, in cross section, illustrating steps of the method of assembling the rocker arm assembly.

As illustrated in FIG. 3, rolling members 14, bearing cups 16 and bearing sleeves 18 form subassemblies 46 and 48 that can be inserted through a top "window" of rocker arm 10 into central cavity 50 of rocker arm 10 and moved laterally outwardly, as indicated by dotted lines and arrows, into final position within apertures 52 and 54. Beveled edges 56 may be provided at apertures 52 and 56 to guide bearing cups 16 and facilitate insertion of subassemblies 46 and 48.

Support member 12 is inserted laterally into rocker arm 10 after insertion of subassemblies 46 and 48, as indicated by a dotted line and arrow. Preferably, insertion of support member 12 into bearing sleeves 18 is facilitated by providing beveled surfaces 58, that increase the inner diameter of bearing sleeves 18 at their axially outward ends, and by providing a clearance fit between support member 12 and bearing sleeves 18. The clearance fit also may allow bearing sleeves 18 to precess, thereby distributing wear over their circumference.

Subassemblies 46 and 48 do not require a press fit between bearing cups 16 and the bore of the rocker arm forming apertures 52 and 54 because flange 42 on the outside diameter of bearing cups 16 prevents the bearing cups from "walking" outward. Because a press fit is not needed, machining of the rocker arm bore can be eliminated altogether or reduced. Preferably, a clearance fit or a "loose" fit is provided between the rocker arm and bearing cups 16 to allow the bearing cups to precess during operation, thereby distributing wear over the circumference of the bearing cups.

From the above description, it will be apparent that the present invention provides a rocker arm assembly that ensures axial retention of the bearing cups of needle roller bearings while eliminating the need for split rings or a press fit between the bearing cups and the bore of the rocker arm. The present invention also provides a method of assembling a rocker arm assembly to ensure axial retention of the bearing cups of needle roller bearings without employing split rings or a press fit between the bearing cups and the bore of the rocker arm.

Having described the invention, what is claimed is:

1. A rocker arm assembly comprising:

a rocker arm having a bore extending along an axis;

a bearing support member having two support arms extending in opposite directions along the axis of the bore;

a bearing cup extending over at least a portion of each support arm and into the bore of the rocker arm, each bearing cup having a radially outwardly extending abutment means, engageable with the rocker arm such that axially outward movement of the bearing cup is limited, and a radially inwardly extending abutment means; and rolling members within an annulus between the bearing support member and the bearing cups such that the rocker arm is rotatable with respect to the bearing support member and such that axially outward movement of the rolling members is limited by engagement with the radially inwardly extending abutment means of the bearing cups.

2. The rocker arm assembly according to claim 1, further comprising two bearing sleeves, one bearing sleeve mounted over each support arm between the rolling members and the respective support arm.

3. The rocker arm assembly according to claim 1, wherein the radially outwardly extending abutment means of the bearing cup is a circumferential flange.

4. The rocker arm assembly according to claim 1, wherein the radially inwardly extending abutment means of the bearing cup is a circumferential flange.

5. The rocker arm assembly according to claim 2, wherein the bearing sleeve includes a radially outwardly extending abutment means engageable with the rolling members such that axially inward movement of the rolling members is limited.

6. The rocker arm assembly according to claim 5, wherein the radially outwardly extending abutment means of the bearing sleeve is a circumferential flange.

7. The rocker arm assembly according to claim 1, further comprising a pedestal positioned between the bearing cups and abutting the support member.

8. The rocker arm assembly according to claim 7, further comprising two bearing sleeves, one bearing sleeve mounted over each support arm between the rolling members and the respective support arm.

9. The rocker arm assembly according to claim 8, wherein the bearing sleeve includes a radially outwardly extending abutment means engageable with the pedestal and with the rolling members such that axially inward movement of the rolling members is limited.

10. The rocker arm assembly according to claim 9, wherein the radially outwardly extending abutment means of the bearing sleeve is a circumferential flange.

11. The rocker arm assembly according to claim 9, wherein the radially outwardly extending abutment means of the bearing sleeve includes a step.

12. The rocker arm assembly according to claim 1, wherein a clearance fit is provided between the bearing cups and the bore of the rocker arm.

13. The rocker arm assembly according to claim 2, wherein a clearance fit is provided between the bearing sleeves and the bearing support member.

14. A method of assembling a rocker arm assembly, the method comprising the steps of:

providing a rocker arm having a bore extending along an axis and having an opening intersecting the bore;

loading rolling members into two bearing cups to form two subassemblies, the bearing cups each having a radially inwardly extending abutment means for limiting axial movement of the rolling members and a radially outwardly extending abutment means;

inserting the two subassemblies through the opening in the rocker arm and into at least a portion of the bore of the rocker arm such that the radially outwardly extending abutment means abuts the rocker arm to limit axially outward movement of the bearing cup; and inserting a support member into the bore of the rocker arm such that the rolling members are located between the bearing cups and the support member and such that the rolling members provide free rotation of the rocker arm about the support member.

15. The method according to claim 14, wherein the subassemblies each further comprise a bearing sleeve providing an inner raceway for the rolling members and providing an outwardly extending abutment means for limiting axially inward movement of the rolling members.

16. The method according to claim 15, further comprising the step of positioning a pedestal against the support member after the support member is inserted into the bore of the rocker arm, such that the pedestal is engageable by the bearing sleeve to limit movement of the bearing sleeve.

* * * * *